US005709307A

United States Patent [19]

Rosado et al.

[11] Patent Number: 5,709,307

[45] Date of Patent: Jan. 20, 1998

[54] INSULATED LUNCH CONTAINER

[76] Inventors: Mildred M. Rosado, 3101 N. Kedzie, Chicago, Ill. 60618; Luis R. Fasco, 4535 W. Birchwood, Skokie, Ill. 60076

[21] Appl. No.: 623,137

[22] Filed: Mar. 28, 1996

[51] Int. Cl.[6] ..... A45C 11/20; F25D 3/08

[52] U.S. Cl. ..... 206/548; 62/457.5; 62/547.7; 150/901; 206/545

[58] Field of Search ..... 706/541, 545, 706/548, 549; 62/457.1, 457.2, 457.3, 457.4, 457.5, 457.7; 150/901; 190/124, 125

[56] References Cited

U.S. PATENT DOCUMENTS

| | | | |
|---|---|---|---|
| 2,783,874 | 8/1957 | Brown et al. . | |
| 4,640,392 | 2/1987 | Decker, Jr. et al. . | |
| 4,648,512 | 3/1987 | Tarozzi et al. . | |
| 4,765,476 | 8/1988 | Lee . | |
| 5,005,679 | 4/1991 | Hjelle | 206/545 X |
| 5,048,734 | 9/1991 | Long | 62/457.1 X |
| 5,293,583 | 3/1994 | Chudgar | 206/541 X |
| 5,421,172 | 6/1995 | Jones | 62/457.5 |
| 5,501,338 | 3/1996 | Preston | 206/545 |

*Primary Examiner*—Bryon P. Gehman
*Attorney, Agent, or Firm*—Joseph N. Breaux

[57] ABSTRACT

An insulated lunch container including a bottom insulating member, a top insulating member; and a cover member having pockets for receiving the top and bottom insulating members therein. The top and bottom insulating members are held within the pockets by sets of hook and pile fasteners positioned within channels formed on the exterior surfaces of the top and bottom insulating members.

18 Claims, 2 Drawing Sheets

INSULATED LUNCH CONTAINER

TECHNICAL FIELD

The present invention relates to containers for storing and carrying food and drink items to a remote location for consumption within several hours and more particularly to an insulated container for storing and carrying food and drink items to a remote location for consumption within several hours that has a removable cover that may be removed and laundered.

BACKGROUND ART

It is often desirable to prepare a lunch or other meal for consumption at a remote location and at a later time. The food is generally prepared and placed within a reusable carrying container and then transported and stored within the reusable container until it is time to consume the food. These reusable containers, especially the exterior surfaces, can become dirty through use and contact with food items. It would be desirable, therefore, to have a reusable food transportation and storage container that included an outer cover that could be easily removed and laundered.

Because it may be desirable to maintain the food items in a cold or hot condition for a period of time, it would also be desirable if the reusable food transportation and storage container having a launderable outer cover also included an insulated food storage chamber. Because different items would best be insulated by direct or close contact with the insulating material it would be a further benefit if the insulated chamber were provided with a plurality of food storage cavities adapted to receive therein such items as standard drink boxes and cans, as well as cylindrically shaped plastic food containers.

GENERAL SUMMARY DISCUSSION OF INVENTION

It is thus an object of the invention to provide an insulated lunch container that includes an outer cover that is easily removed and laundered.

It is a further object of the invention to provide an insulated lunch container that includes a launderable outer cover in addition to an insulated food storage chamber.

It is a still further object of the invention to provide an insulated lunch container that includes an insulated chamber provided with a plurality of food storage cavities adapted to receive therein such items as standard drink boxes and cans, as well as cylindrically shaped plastic food containers.

It is a still further object of the invention to provide an insulated lunch container that all or some of the above objects in combination.

Accordingly, an insulated lunch container is provided. The lunch container includes a bottom insulating member constructed from a plastic foam material having a substantially open box shape having a bottom cavity formed therein, a bottom exteriorly facing surface of the bottom insulating member having a bottom fastener channel formed there along, and a first length of hook type hook-and-pile fastener strip disposed within the bottom fastener channel, the bottom fastener channel having a bottom channel fastener depth about equal to twice the thickness of the fastener strip; a top insulating member constructed from a plastic foam material having a substantially open box shape having a top cavity formed therein, a top exteriorly facing surface of the top insulating member having a top fastener channel formed there along, and a second length of hook-and-pile fastener strip disposed within the top fastener channel, the top fastener channel having a top channel fastener depth about equal to twice the thickness of the fastener strip, the top and bottom insulating members having top and bottom opening perimeters that are positionable in registration in a manner to form a food storage cavity including the top and bottom cavities; and a fabric cover member having a first insulating member receiving pocket defined by a first insulating pocket inner surface and sized to receive therein the top insulating member, and a second insulating member receiving pocket defined by a second insulating pocket inner surface and sized to receive therein the bottom insulating member, the cover member having a covering opening of sufficient size to allow introduction of the top and bottom insulating members into the first and second insulating member receiving pockets that is sealable with a closure mechanism provided about the perimeter thereof, the first insulating pocket inner surface having a third length of hook and pile fastener strip secured thereto and positioned thereon in a manner such that when the top insulating member is positioned within the first insulating member receiving pocket the third length of hook and pile fastener strip is positioned within the top fastener channel and into securing contact with the second length of hook-and-pile fastener strip disposed within the top fastener channel, the second insulating pocket inner surface having a fourth length of hook and pile fastener strip secured thereto and positioned thereon in a manner such that when the bottom insulating member is positioned within the second insulating member receiving pocket the fourth length of hook and pile fastener strip is positioned within the bottom fastener channel and into securing contact with the first length of hook-and-pile fastener strip disposed within the bottom fastener channel.

The bottom insulating member is preferably provided with a plurality of standard shaped cavities for receiving therein items such as drink cans and boxes and standard shaped sealable plastic food containers. An insulating insert member, positionable within the bottom cavity of the bottom insulating member, can also be provided that includes the previously mentioned standard shaped cavities.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
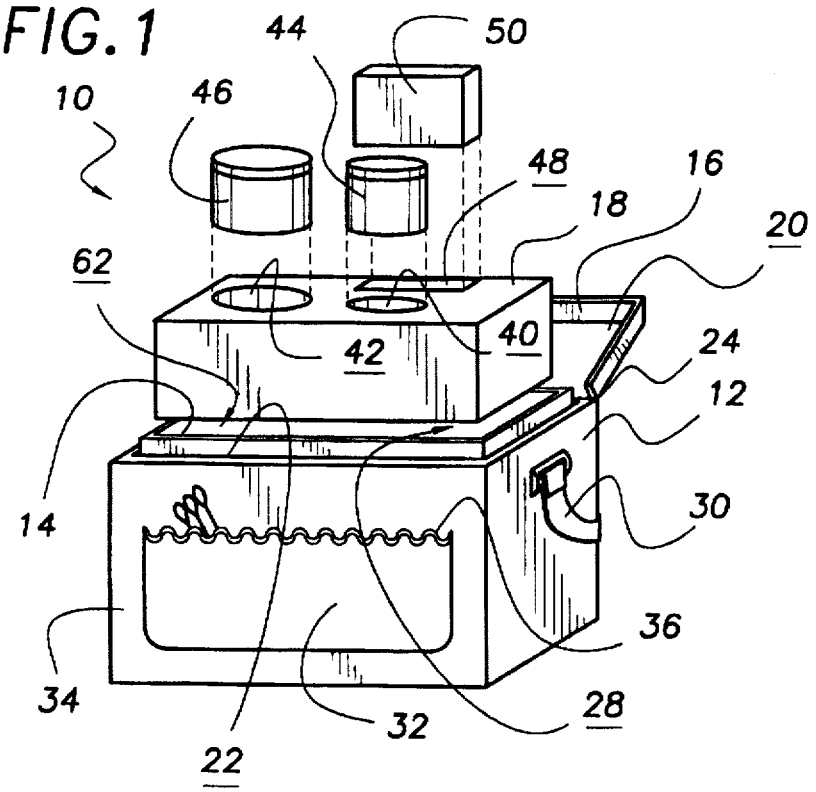
FIG. 1 is a perspective view of an exemplary embodiment of the insulated lunch container of the present invention showing the top and bottom insulating members positioned within the first and second insulating member receiving pockets of the fabric cover member and an exemplary insulating insert member having two cylindrically shaped cavities and one rectangular shaped cavity.

FIG. 1 shows an exemplary embodiment of the insulated lunch container of the present invention generally designated by the numeral 10. Lunch container 10 includes a fabric outer cover 12, a bottom insulating member 14, a top insulating member 16, and an insulating insert member 18. Fabric outer cover includes first and second insulating member receiving pockets 20,22 that are sized to receive therein respectively top and bottom insulating members 16,14. Cover member 12 also includes a conventional zipper closure mechanism 24 that is secured about the perimeter of a covering opening 28 that is sized to allow introduction of top and bottom insulating members 16,14 into first and second insulating member receiving pockets 20,22. A carrying strap assembly 30 is secured to the exterior of covering member 12 to allow for convenient carrying of lunch container 10. A condiment pocket member 32 is provided on an exterior side surface 34 for holding condiments and other items. An elasticized top edge 36 of condiment pocket 32 is provided for retaining condiment and food utensil items within condiment pocket 32.

Insulating insert member 18 is constructed from plastic foam and is sized to fit within a bottom cavity 62 of bottom insulating member 14. Insulating insert member is provided with first and second cylindrically shaped cavities 40,42 sized to receive therein a standard twelve ounce beverage can 44 and a conventional plastic food container 46, respectively. A rectangular shaped cavity 48 is also provided that is sized to receive therein a convention drink box 50.

Figure 2:
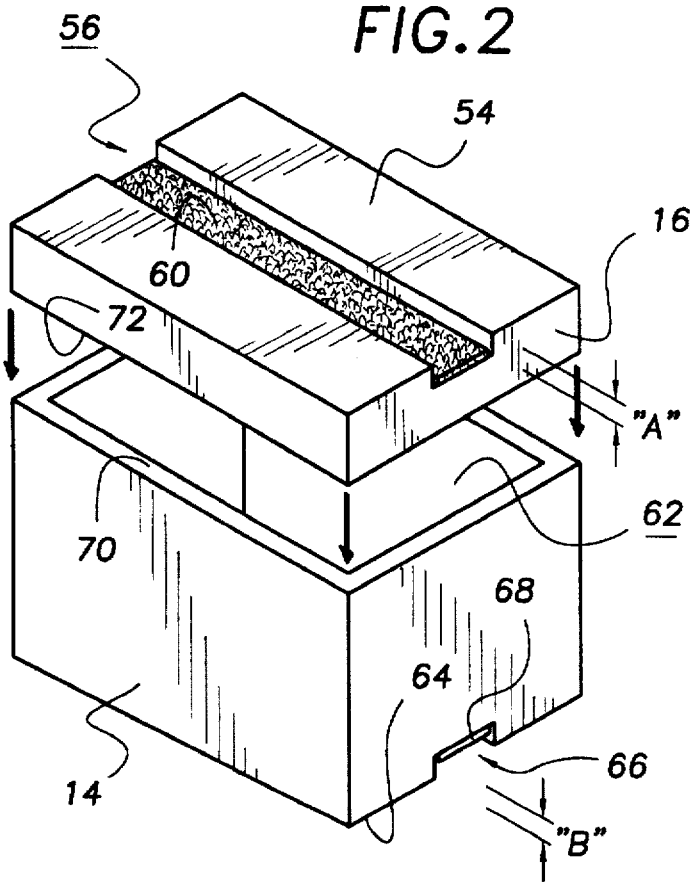
FIG. 2 is a perspective view of the top and bottom insulating members showing the top and bottom fastener channels.

FIG. 2 shows top and bottom insulating members 16,14 in isolation. Top insulating member 16 is constructed from a plastic foam material and has a substantially open box shape having a top cavity 52 (shown in FIG. 3 and 4) formed therein. A top exteriorly facing surface 54 of top insulating member 16 has a top fastener channel 56 formed there along. A length of hook-and-pile fastener strip 60 is secured to a bottom surface of top fastener channel with an adhesive. Top fastener channel 56 has a depth "A" equal to about twice the thickness of fastener strip 60.

Bottom insulating member 14 is constructed from a plastic foam material and has a substantially open box shape having bottom cavity formed 62 formed therein. A bottom exteriorly facing surface 64 of bottom insulating member 14 has a bottom fastener channel 66 formed there along. A length of hook type hook-and-pile fastener strip 68 is adhesively secured the bottom surface of bottom fastener channel 66. Bottom fastener channel 66 has a bottom channel fastener depth "B" equal to about twice the thickness of fastener strip 68.

Figure 3:
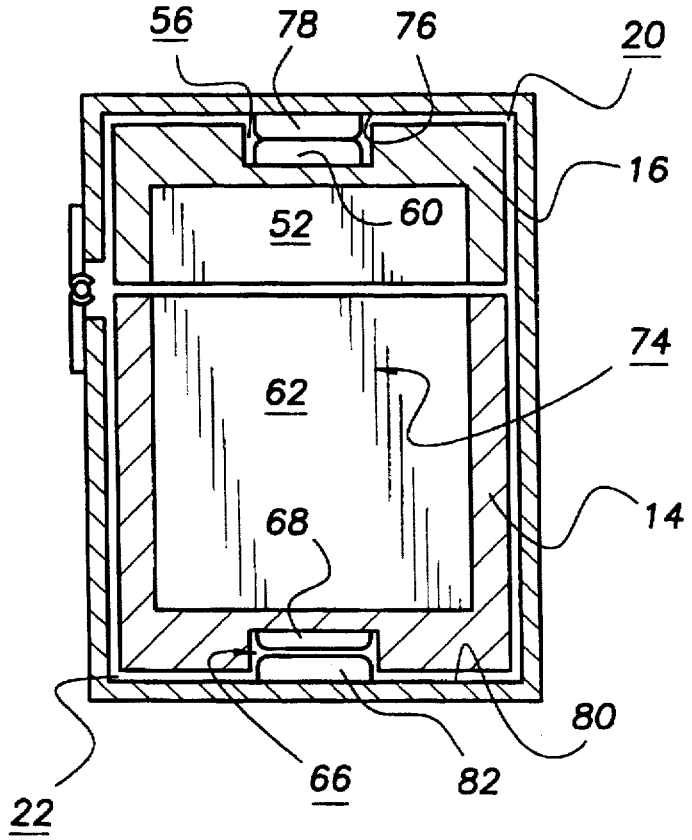
FIG. 3 is a width wise cross sectional view of the insulated lunch container of FIG. 1 with the top and bottom insulating members positioned within the first and second insulating member receiving pockets of the fabric cover member and the cover opening of the cover member sealed by a preferred zipper type closure mechanism.

Top and bottom insulating members 16,14 have top and bottom opening perimeters 70,72 that are positionable into registration with each other to form a food storage cavity. With reference to FIG. 3, food storage cavity 74 includes top and bottom cavities 52,62.

FIG. 3 also shows a first insulating pocket inner surface 76 having a length 78 of hook and pile faster strip, adapted to mateably connect with fastener strip 60, secured thereto and positioned thereon in a manner such that when top insulating member 16 is positioned within first insulating member receiving pocket 20 length 78 of hook and pile fastener strip is positioned within top fastener channel 56 and into securing contact with fastener strip 60.

Figure 4:
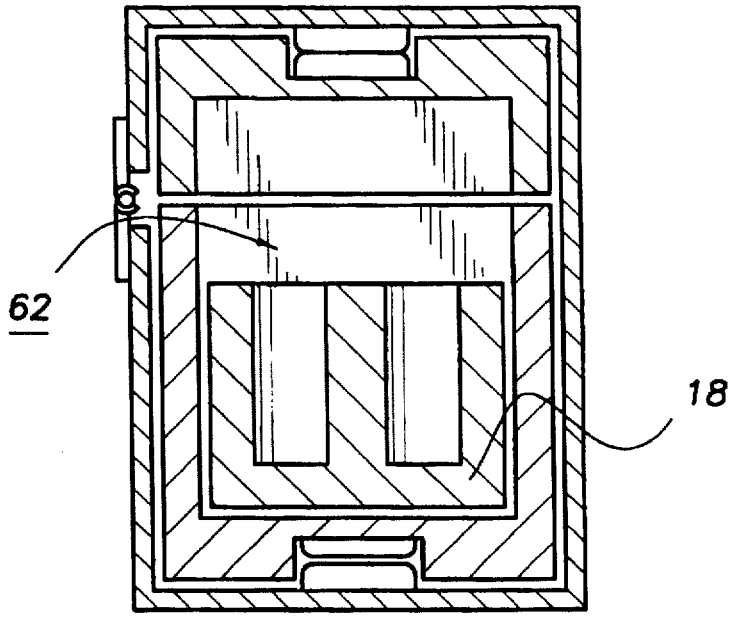
FIG. 4 is a second width wise cross sectional view of the insulated lunch container of FIG. 1 with the insulated insert member positioned within the bottom cavity of the bottom insulating member.

A second insulating pocket inner surface 80 is also shown having a length 82 of hook and pile faster strip, adapted to mateably connect with fastener strip 68, secured thereto and positioned thereon in a manner such that, when bottom insulating member 14 is positioned within second insulating member receiving pocket 22, length 82 of hook and pile fastener strip is positioned within bottom fastener channel 66 and into securing contact with fastener strip 68. FIG. 4 shows insulating insert member 18 positioned within bottom cavity 62. Selecting the depths "A","B" of top and bottom fastener channels 56,66 to be about twice the thickness of fastener strips 60,68 allows lengths 78,82 to be disposed, respectively within a fastener channel 56,66 and allows lunch container 10 to have a substantially flat top and bottom.

Use of lunch container 10 is now described with general reference to FIGS. 1–4. Lunch container 10 is assembled by first placing top insulating member 16 into first insulating member receiving pockets 20 in a manner such that length 78 of hook and pile fastener strip is positioned within top fastener channel 56 and into securing contact with fastener strip 60. Bottom insulating member 14 is then inserted into second insulating pocket inner surface 80 in a manner such that length 82 of hook and pile faster strip mateably connects with fastener strip 68.

Lunch container 10 may used with or without insulated insert member 18. When insulated insert member 18 is used, insulated insert member 18 is inserted into bottom cavity 62. Additional food items may be placed beneath insulated insert member 18 or on top thereof. Lunch container 10 is sealed by pivoting top and bottom opening perimeters 70,72 into registration with each other and then closing zipper 24. If desired, condiments, eating utensils, etc. can be placed into condiment pocket 32 by stretching elasticized top edge 36 away from exterior side surface 34 and placing the desired items therein.

When cover member 12 becomes soiled or contaminated, top and bottom insulating members 16,14 are removed from first and second insulating member receiving pockets 20,22 and cover member 12 laundered either by hand or machine.

It can be seen from the preceding description that an insulated lunch container has been provided that includes an outer cover that is easily removed and laundered; that includes an insulated food storage chamber; and that includes an insulated chamber provided with a plurality of food storage cavities.

It is noted that the embodiment of the insulated lunch container described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An insulated lunch container comprising:

a bottom insulating member constructed from a plastic foam material having a substantially open box shape having a bottom cavity formed therein, a bottom exteriorly facing surface of said bottom insulating member having a bottom fastener channel formed there along, and a first length of hook type hook-and-pile fastener strip disposed within said bottom fastener channel, said bottom fastener channel having a bottom fastener channel depth about equal to twice a first thickness of said first length of fastener strip;

a top insulating member constructed from a plastic foam material having a substantially open box shape having a top cavity formed therein, a top exteriorly facing surface of said top insulating member having a top fastener channel formed there along, and a second length of hook-and-pile fastener strip disposed within said top fastener channel, said top fastener channel having a top fastener channel depth about equal to twice a second thickness of said second length of fastener strip, said top and bottom insulating members having top and bottom opening perimeters that are positionable in registration in a manner to form a food storage cavity including said top and bottom cavities; and a fabric cover member having a first insulating member receiving pocket defined by a first insulating pocket inner surface and sized to receive therein said top insulating member, and a second insulating member receiving pocket defined by a second insulating pocket inner surface and sized to receive therein said bottom insulating member, said cover member having a covering opening of sufficient size to allow introduction of said top and bottom insulating members into said first and second insulating member receiving pockets that is sealable with a closure mechanism provided about a cover perimeter thereof, said first insulating pocket inner surface having a third length of hook-and-pile fastener strip secured thereto and positioned thereon in a manner such that when said top insulating member is positioned within said first insulating member receiving pocket, said third length of hook and pile fastener strip is positioned within said top fastener channel and into securing contact with said second length of hook-and-pile fastener strip disposed within said top fastener channel, said second insulating pocket inner surface having a fourth length of hook-and-pile fastener strip secured thereto and positioned thereon in a manner such that when said bottom insulating member is positioned within said second insulating member receiving pocket, said fourth length of hook-and-pile fastener strip is positioned within said bottom fastener channel and into securing contact with said first length of hook-and-pile fastener strip disposed within said bottom fastener channel.

2. The insulated lunch container of claim 1, wherein:

said bottom insulating member is provided with a plurality of standard shaped cavities.

3. The insulated lunch container of claim 1, wherein: .

said lunch container further includes an insulating insert member adapted to be positionable within said bottom cavity of said bottom insulating member that includes a plurality of standard shaped cavities.

4. The insulated lunch container of claim 3 wherein:

said cover member further includes a carrying strap assembly secured to an exterior surface of said covering member.

5. The insulated lunch container of claim 3 wherein:

said cover member further includes a condiment pocket member secured to an exterior side surface of said cover member.

6. The insulated lunch container of claim 5 wherein:

said condiment pocket member includes an elasticized top edge.

7. The insulated lunch container of claim 4 wherein:

said cover member further includes a condiment pocket member secured to an exterior side surface of said cover member.

8. The insulated lunch container of claim 7 wherein:

said condiment pocket member includes an elasticized top edge.

9. The insulated lunch container of claim 1 wherein:

said cover member further includes a carrying strap assembly secured to an exterior surface of said covering member.

10. The insulated lunch container of claim 9 wherein:

said cover member further includes a condiment pocket member secured to an exterior side surface of said cover member.

11. The insulated lunch container of claim 10 wherein:

said condiment pocket member includes an elasticized top edge.

12. The insulated lunch container of claim 1 wherein:

said cover member further includes a condiment pocket member secured to an exterior side surface of said cover member.

13. The insulated lunch container of claim 12 wherein:

said condiment pocket member includes an elasticized top edge.

14. The insulated lunch container of claim 2 wherein:

said cover member further includes a carrying strap assembly secured to an exterior surface of said covering member.

15. The insulated lunch container of claim 14 wherein:

said cover member further includes a condiment pocket member secured to an exterior side surface of said cover member.

16. The insulated lunch container of claim 15 wherein:

said condiment pocket member includes an elasticized top edge.

17. The insulated lunch container of claim 2 wherein:

said cover member further includes a condiment pocket member secured to an exterior side surface of said cover member.

18. The insulated lunch container of claim 17 wherein:

said condiment pocket member includes an elasticized top edge.

* * * * *